US010104476B2

(12) United States Patent
Ge et al.

(10) Patent No.: US 10,104,476 B2
(45) Date of Patent: Oct. 16, 2018

(54) MINIATURE LOUDSPEAKER

(71) Applicant: GOERTEK INC., WeiFeng, Shandong (CN)

(72) Inventors: Lianshan Ge, Weifang (CN); Wenqiang Dong, WeiFang (CN); Tianli Guo, WeiFang (CN)

(73) Assignee: GOERTEK INC., WeiFang, Shandong (CN)

( * ) Notice: Subject to any disclaimer, the term of this patent is extended or adjusted under 35 U.S.C. 154(b) by 0 days.

(21) Appl. No.: 15/532,066

(22) PCT Filed: Nov. 11, 2015

(86) PCT No.: PCT/CN2015/094261
§ 371 (c)(1),
(2) Date: May 31, 2017

(87) PCT Pub. No.: WO2016/086758
PCT Pub. Date: Jun. 9, 2016

(65) Prior Publication Data

US 2017/0265008 A1 Sep. 14, 2017

(30) Foreign Application Priority Data

Dec. 2, 2014 (CN) ..... 2014 1 0724604

(51) Int. Cl.
*H04R 9/06* (2006.01)
*H04R 1/28* (2006.01)
(Continued)

(52) U.S. Cl.
CPC ..... *H04R 9/06* (2013.01); *H04R 1/288* (2013.01); *H04R 7/18* (2013.01); *H04R 9/025* (2013.01); *H04R 2400/11* (2013.01)

(58) Field of Classification Search
CPC ..... H04R 1/025; H04R 1/288; H04R 7/127; H04R 7/18; H04R 9/02; H04R 9/025;
(Continued)

(56) References Cited

U.S. PATENT DOCUMENTS 4,433,214 A * 2/1984 Jasinski ..... H04R 7/20 181/172
5,664,024 A * 9/1997 Furuta ..... H04R 7/127 381/396
(Continued)

FOREIGN PATENT DOCUMENTS

CN 102036151 A 4/2011
CN 202841515 U 3/2013
(Continued)

*Primary Examiner* — Huyen D Le
(74) *Attorney, Agent, or Firm* — Holzer Patel Drennan

(57) ABSTRACT

A loudspeaker module emitting sound at a lateral side comprises a loudspeaker unit and a module housing comprising a lower module housing, a middle module housing and an upper module housing. A space formed by the loudspeaker unit, the middle module housing and the lower module housing is a rear sound cavity. A space formed by the loudspeaker unit, the middle module housing and the upper module housing is a front sound cavity. The loudspeaker module further comprises a cover plate which forms a cavity together with the upper module housing. The cavity is communicated with the rear sound cavity through a conducting hole. By utilizing the loudspeaker module of the present invention, superfluous space of the upper module housing can be converted into the rear sound cavity, and therefore the size of the rear sound cavity is increased, and the acoustic performance of the loudspeaker module is improved.

6 Claims, 6 Drawing Sheets

(51) Int. Cl.
*H04R 7/18* (2006.01)
*H04R 9/02* (2006.01)

(58) Field of Classification Search
CPC ..... H04R 9/06; H04R 9/10; H04R 2400/11; H04M 1/035
USPC ..... 381/353, 354, 396, 398, 412, 414, 423, 381/430, 431, 433
See application file for complete search history.

(56) References Cited

U.S. PATENT DOCUMENTS

| | | | | |
|---|---|---|---|---|
| 8,300,871 | B2 * | 10/2012 | Welsh | H04R 1/24 381/182 |
| 2004/0218779 | A1 * | 11/2004 | Fukuyama | H04R 1/06 381/409 |
| 2006/0153417 | A1 * | 7/2006 | Furuya | H04M 1/035 381/396 |

FOREIGN PATENT DOCUMENTS

| | | | |
|---|---|---|---|
| CN | 203015105 | U | 6/2013 |
| CN | 203301734 | U | 11/2013 |
| CN | 203984670 | U | 12/2014 |
| CN | 104410945 | A | 3/2015 |
| CN | 204291366 | U | 4/2015 |

* cited by examiner

MINIATURE LOUDSPEAKER

TECHNICAL FIELD

The present invention relates to the technical field of electro-acoustic, and more particularly to a micro loudspeaker.

BACKGROUND

In the technical field of micro loudspeakers, a yoke, a magnet and a washer together constitute a magnetic circuit system, which affects the performance of micro loudspeaker products. While in the conventional micro loudspeaker structure, a sound hole is typically provided on the bottom plane of the product, thus the yoke needs to be performed with blank pressing or trepanning process so as to make room for pasting a dust screen for the sound hole. For the micro loudspeakers, since the yoke is part of the magnetic circuit system, it will affect the magnetic conductive process of the product when the yoke is performed with blank pressing or trepanning process, resulting in damage to product performance of the micro loudspeaker. In addition, it is necessary to ensure that the bottom plane of the product is flush with the assembly surface of overall machine when the micro loudspeakers is assembled with the terminal during overall machine assembly, and thus the sound hole in the bottom plane of the product is easy to be blocked, which affects the installation test curve.

Therefore, it is necessary to improve the design for the existing micro loudspeaker structure, especially the design for the position of the sound hole, so as to reduce damage to product performance as far as possible due to the fact that the yoke is performed with blank pressing or trepanning process, and at the same time, to avoid affecting the installation test curve due to the sound holes being blocked when the product is performed with overall machine assembly

SUMMARY

The technical problem to be solved by the present invention is to provide a micro loudspeaker, wherein the position of the sound hole is seriously redesigned when the component remains unchanged, sound holes are provided symmetrically at the upright edges of the minor axis side portions of the yoke, thereby reducing the loss of the magnetic induction lines, ensuring the magnetic properties of the product, as well as preventing the sound hole from being blocked during system assembly.

In order to achieve the above objective, the present invention adopts the following technical solution: a micro loudspeaker comprising a magnetic circuit system, a vibration system and a support system, wherein the magnetic circuit system comprises a yoke, a magnet accommodated in the yoke and a washer fixed to a surface of the magnet, the vibration system comprises a voice coil and a diaphragm, the support system comprises a housing and a front cover bonded to the housing, the magnetic circuit system and the vibration system are accommodated within a cavity formed by the housing and the front cover, and the yoke comprises a base portion extending in a horizontal direction and side portions protruding in a vertical direction, and wherein two major axis side portions are disposed symmetrically about a major axis of the base portion of the yoke, and two minor axis side portions are disposed symmetrically about a minor axis of the base portion of the yoke, sound holes are provided symmetrically at the two minor axis side portions of the yoke, and positions of the housing which correspond to the sound holes are provided with avoidance structures As an improvement, the minor axis side portions of the yoke have a rectangular structure formed by four upright edges, a bottom part of the sound hole is located at an upper portion of the upright edge at an inner side of the minor axis side portion of the yoke, a top part of the sound hole is lower than the upright edge at an outer side of the minor axis side portion of the yoke, and both ends of the sound hole are located in a space defined by two lateral sides of the minor axis side portion of the yoke.

As an improvement, both the yoke and the sound hole are rectangular.

As an improvement, the sound hole is covered with a damper.

As an improvement, a reinforcing member is bonded to an intermediate position of the diaphragm. An inner edge of the diaphragm surrounds an outer periphery of the reinforcing member.

Compared to the prior art, in the present invention, as the sound hole is provided at the upright edge of the minor axis side portion of the yoke, the magnetic induction lines of the magnetic circuit system accommodated in the yoke are not significantly depleted, and the magnetic properties of the micro loudspeaker product may be well secured. In addition, when the micro loudspeakers are assembled with terminal devices, such as mobile phones, computers and the like during overall machine assembly, the sound hole will not be blocked, thereby avoiding affecting the installation test curve of the product.

Figure 1:
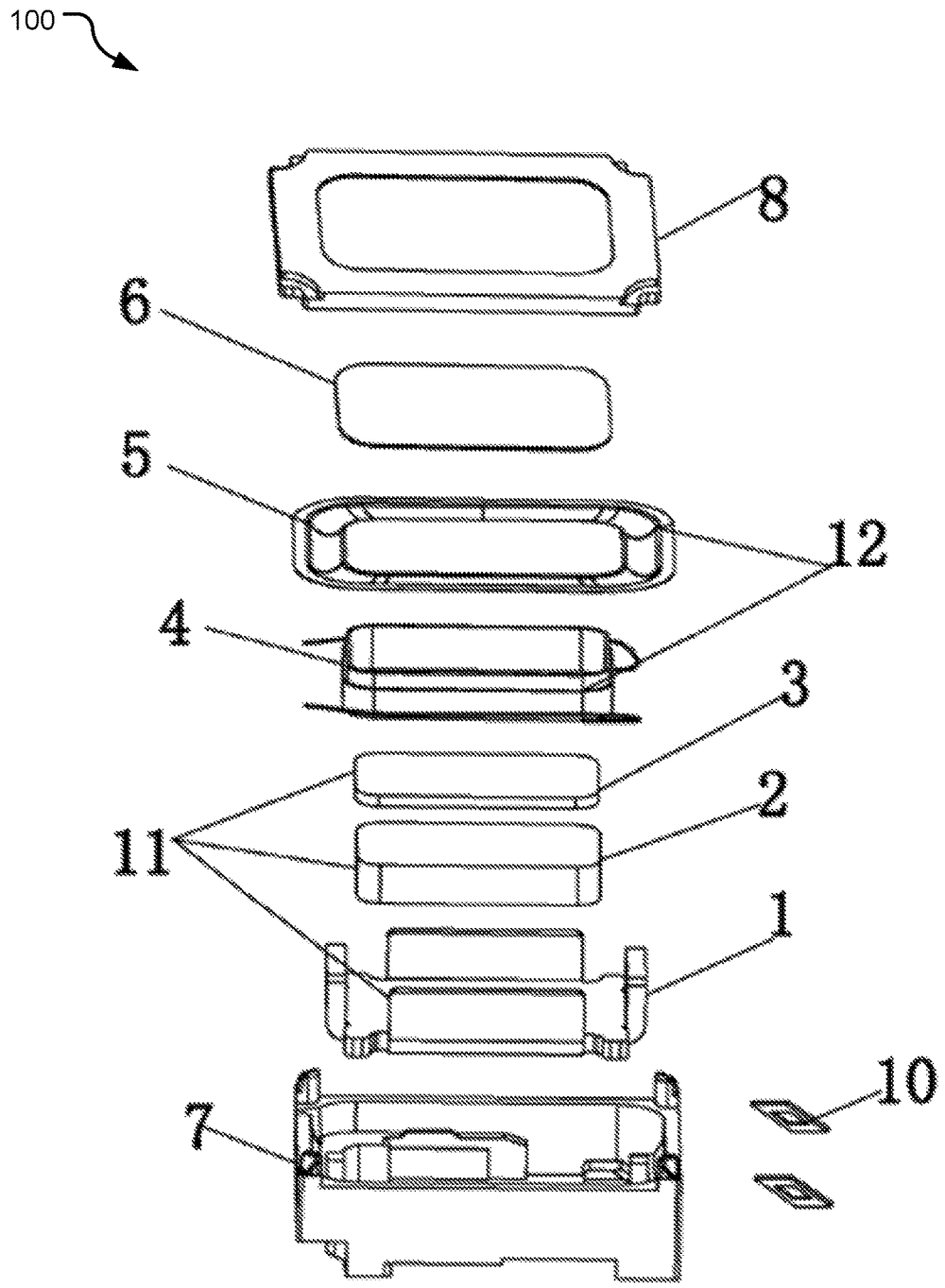
FIG. 1 is a steric exploded schematic view of the micro loudspeaker according to the present invention.
Figure 2:
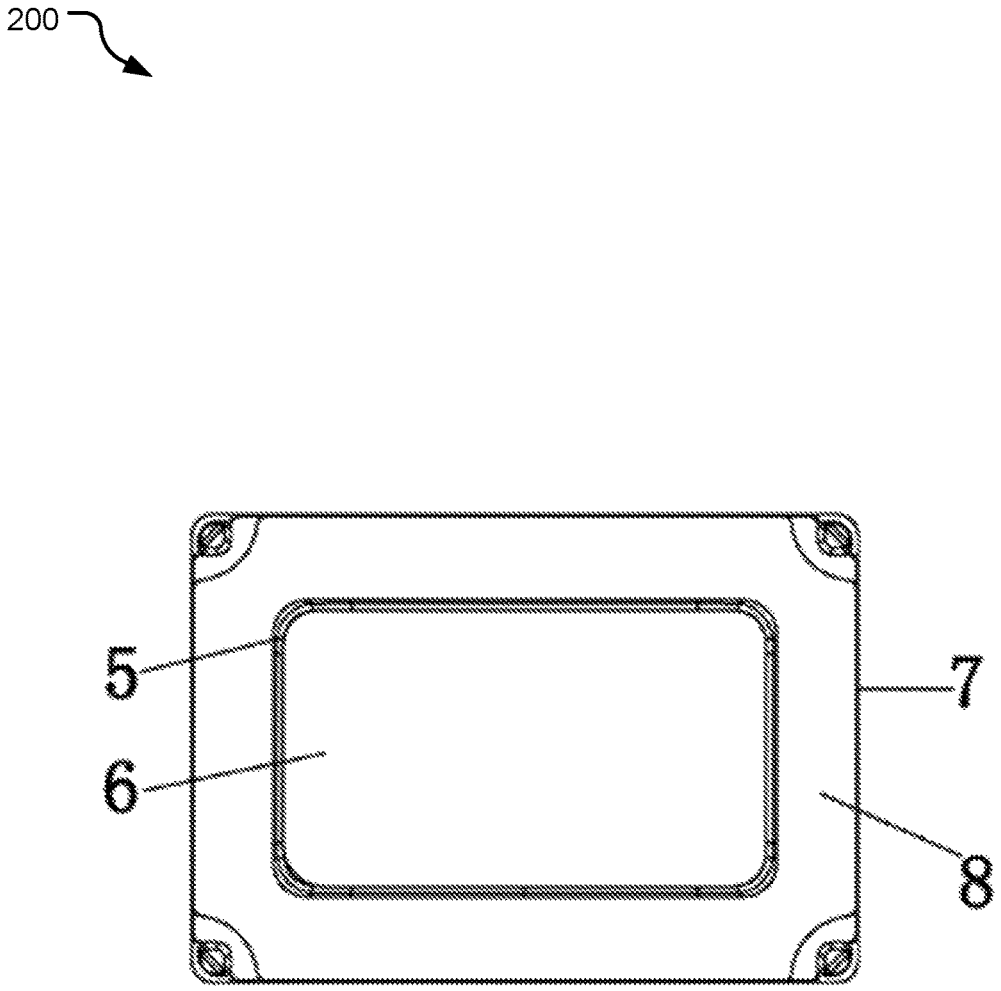
FIG. 2 is a top view of the micro loudspeaker according to the present invention.
Figure 3:
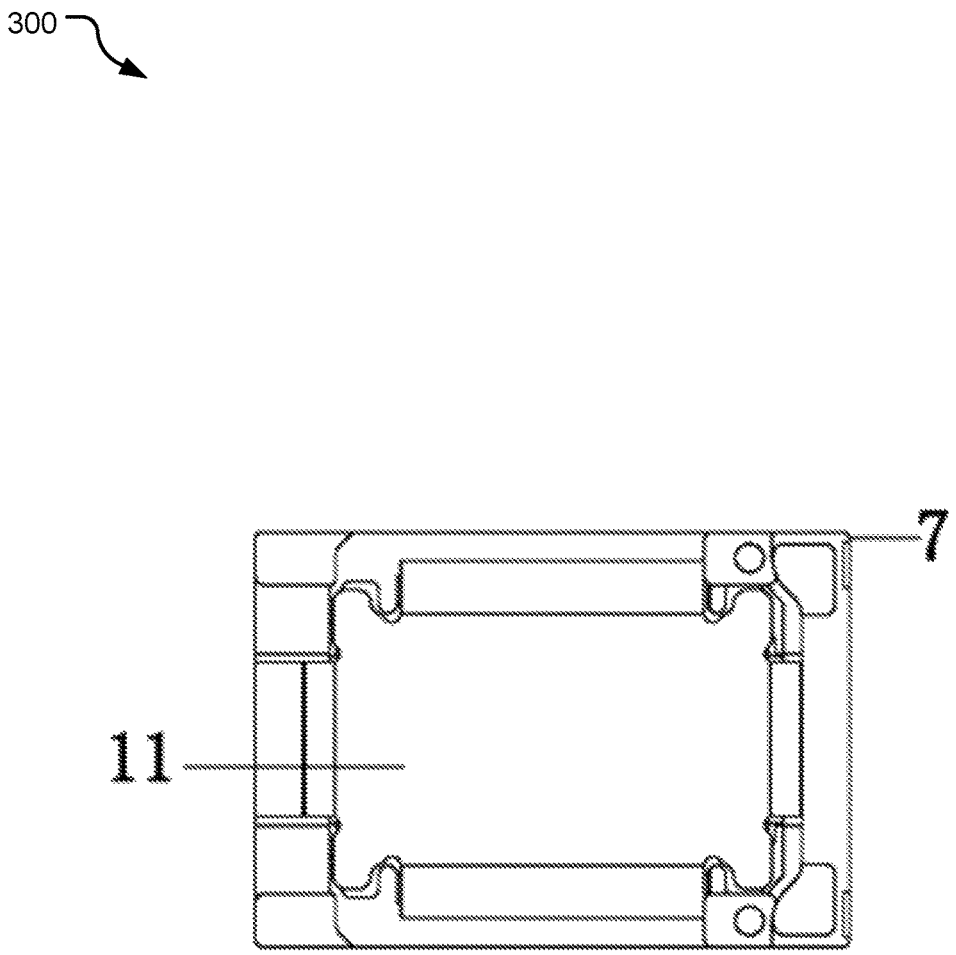
FIG. 3 is a bottom view of the micro loudspeaker according to the present invention.
Figure 4:
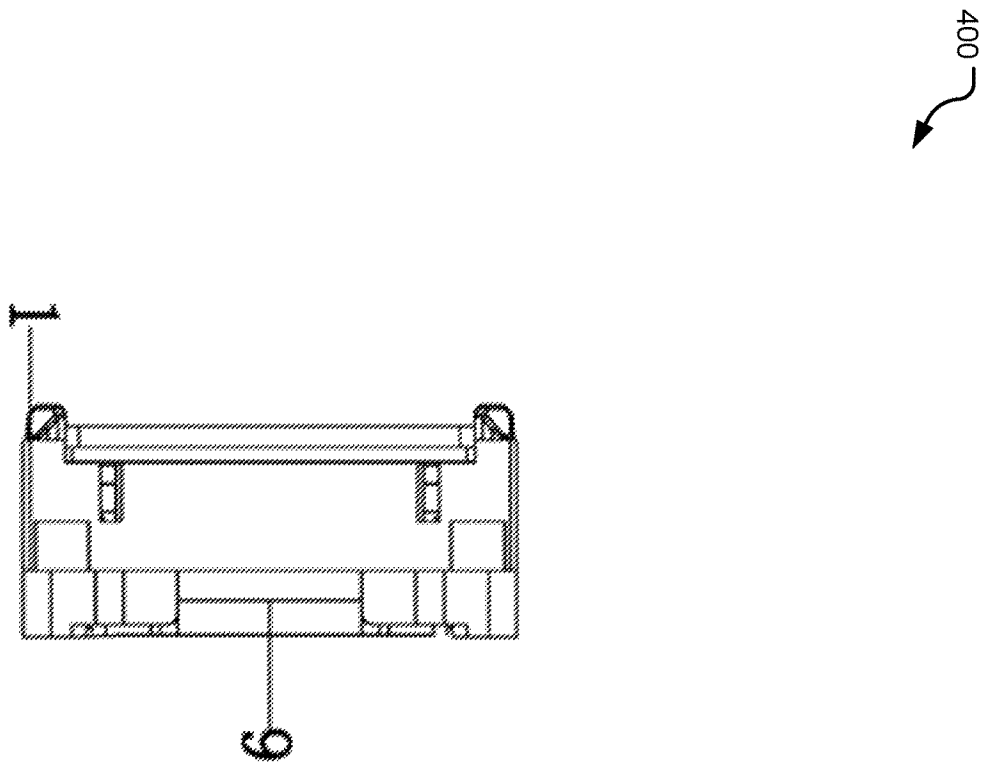
FIG. 4 is a left view of the yoke of the micro loudspeaker according to the present invention at the minor axis thereof.
Figure 5:
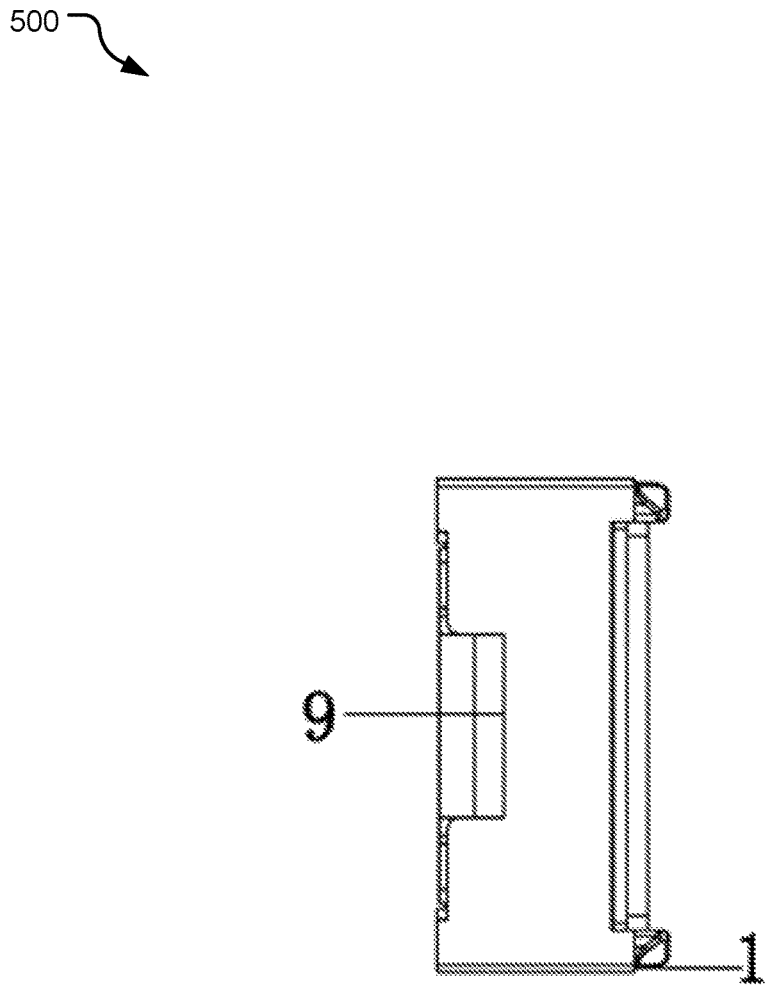
FIG. 5 is a right view of the yoke of micro loudspeaker according to the present invention at the minor axis thereof.
Figure 6:
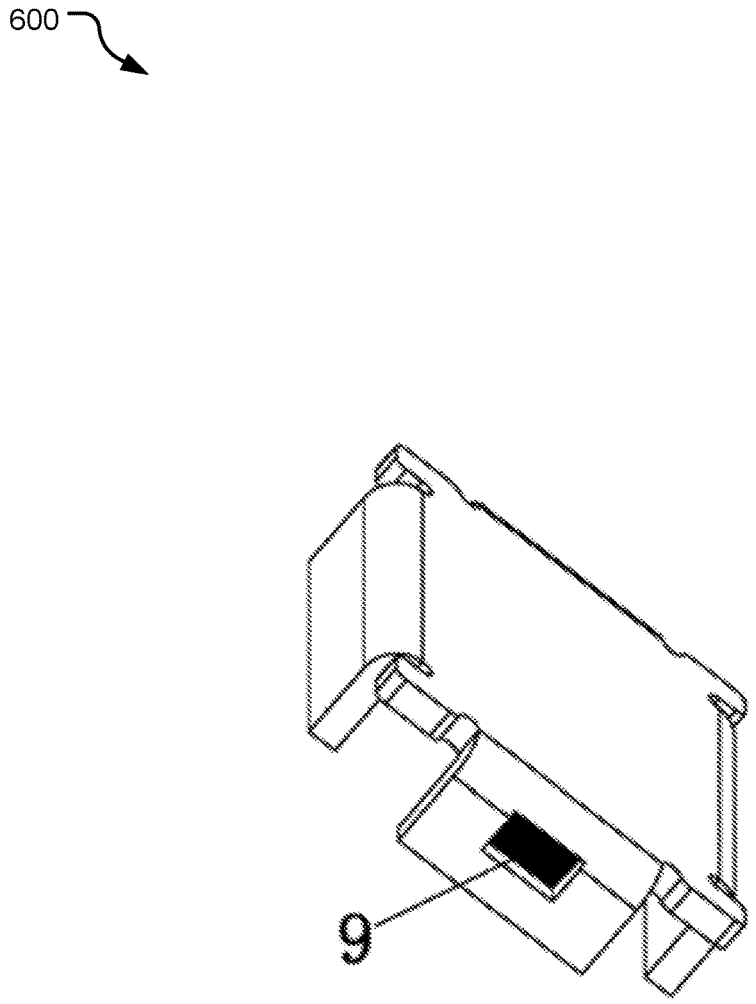
FIG. 6 is a steric view of the yoke of the micro loudspeaker according to the present invention.

The reference numerals comprise: 1, yoke; 2, magnet; 3, washer; 4, voice coil; 5, diaphragm; 6, reinforcing member; 7, housing; 8, front cover; 9, sound hole; 10, damper; 11, magnetic circuit system; 12, vibration system.

DETAILED DESCRIPTION

The present invention will be described in detail with reference to the accompanying drawings.

Referring to FIG. 1, a micro loudspeaker according to the present invention comprises a magnetic circuit system 11, a vibration system 12 and a support system. The magnetic circuit system 11 comprises a yoke 1, a magnet 2 accommodated within the yoke 1, and a washer 3 fixed to the surface of the magnet 2. The vibration system 12 comprises a voice coil 4 and a diaphragm 5. The support system comprises a housing 7 and a front cover 8 combined with the housing 7. The magnetic circuit system 11 and the vibration system 12 are accommodated within a cavity formed by the housing 7 and the front cover 8. The yoke 1 comprises a base portion extending in the horizontal direction and side portions protruding in the vertical direction, wherein two major axis side portions are disposed symmetrically about the major axis of the base portion of the yoke 1, and two minor axis side portions are disposed symmetrically about the minor axis of the base portion of the yoke 1. Sound holes 9 are symmetrically provided at the two minor axis side portions of the yoke 1, and the positions of the housing 7 which correspond to the sound holes 9 are provided with avoidance structures.

For the micro loudspeaker, the position of the sound hole 9 is improved by providing the sound holes on the minor axis side portions of the yoke 1 instead of on the bottom plane of the product according to the above-described technical solution. On one hand, this may reduce the loss of the magnetic induction lines of the magnetic circuit system 11, thus ensuring product performance; on the other hand, when the micro loudspeaker is assembled during overall machine assembly, the bottom plane of the product is flush with the assembly plane, and the sound holes 9 are provided at the minor axis side portions of the yoke 1, and avoidance structures are provided at the positions of the housing 7 which correspond to the sound holes 9, so as to prevent the sound holes 9 from being blocked after completion of product assembly and ensure the effect of the installation test curve.

In a specific implementation, all parts of the magnetic circuit system 11 are fixed with each other by adhesive bonding, wherein a certain distance exists between the magnet 2 and the yoke 1, so as to form a magnetic gap, and the end parts of the voice coil 4 close to the magnetic circuit system 11 is suspended in the magnetic gap. On the other hand, the housing 7 is typically injection-molded with an electric connecting part which is electrically connected with the lead wires of the voice coil 4 inside the micro loudspeaker and is electrically connected with external circuits at the same time, so that the current signals of the external circuits can be transmitted to the voice coil 4 through the electric connecting part. After receiving the current signals, the voice coil 4 may move so as to cut magnetic induction lines back and forth under the action of the electromagnetic field, thereby driving the vibration of the diaphragm 5 connected thereto.

In the present embodiment, the minor axis side portion of the yoke 1 has a rectangular structure formed by four upright edges. The bottom part of the sound hole 9 is located at an upper portion of the upright edge at the inner side of the minor axis side portion of the yoke 1. The top part of the sound hole 9 is lower than the upright edge at the outer side of the minor axis side portion of the yoke 1. Both ends of the sound hole 9 are located in the space defined by two lateral sides of the minor axis side portion of the yoke 1.

In the present embodiment, the yoke 1 and the sound hole 9 are rectangular.

In addition, in the present embodiment, the sound hole 9 is covered with damper 10 so as to adjust the acoustic performance and prevent the invasion of dust.

In the present embodiment, a reinforcing member 6 is bonded to the intermediate position of the diaphragm 5. The inner edge of the diaphragm 5 surrounds the outer periphery of the reinforcing member 6, and generally, the reinforcing member 6 preferably has a rigid composite layer structure, mainly for enhancing performance of the product at high frequency.

The above mentioned are only embodiments of the present invention and are not for restricting the present invention, thus the equivalent modification or variation made by those skilled in the art according to the present invention should be incorporated into the scope of protection recorded in the claims.

What is claimed is:

1. A micro loudspeaker comprising a magnetic circuit system, a vibration system and a support system, wherein the magnetic circuit system comprises a yoke, a magnet accommodated in the yoke and a washer fixed to a surface of the magnet, the vibration system comprises a voice coil and a diaphragm, the support system comprises a housing and a front cover bonded to the housing, the magnetic circuit system and the vibration system are accommodated within a cavity formed by the housing and the front cover, and the yoke comprises a base portion extending in a horizontal direction and side portions protruding in a vertical direction, and wherein two major axis side portions are disposed symmetrically about a major axis of the base portion of the yoke, and two minor axis side portions are disposed symmetrically about a minor axis of the base portion of the yoke, sound holes to reduce the loss of magnetic induction lines of the magnetic circuit system are provided symmetrically at the two minor axis side portions of the yoke, and positions of the housing which correspond to the sound holes are provided with avoidance structures.

2. The micro loudspeaker according to claim 1, wherein the minor axis side portions of the yoke have a rectangular structure formed by four upright edges, a bottom part of the sound hole is located at an upper portion of the upright edge at an inner side of the minor axis side portion of the yoke, a top part of the sound hole is lower than the upright edge at an outer side of the minor axis side portion of the yoke, and both ends of the sound hole are located in a space defined by two lateral sides of the minor axis side portion of the yoke.

3. The micro loudspeaker according to claim 2, wherein both the yoke and the sound hole are rectangular.

4. The micro loudspeaker according to claim 2, wherein the sound hole is covered with a damper.

5. The micro loudspeaker according to claim 1, wherein a reinforcing member is bonded to an intermediate position of the diaphragm, and an inner edge of the diaphragm surrounds an outer periphery of the reinforcing member.

6. The micro loudspeaker according to claim 1, wherein a certain distance exists between the magnet and the yoke, to form a magnetic gap, and the end parts of the voice coil close to the magnetic circuit system is suspended in the magnetic gap.

* * * * *